United States Patent [19]

Forbes, Jr.

[11] 4,108,350

[45] Aug. 22, 1978

[54] CARTON WITH INTEGRAL REMOVABLE CARD

[75] Inventor: Hampton E. Forbes, Jr., Wilmington, Del.

[73] Assignee: Westvaco Corporation, New York, N.Y.

[21] Appl. No.: 812,156

[22] Filed: Jul. 1, 1977

[51] Int. Cl.[2] ..... B65D 5/00

[52] U.S. Cl. ..... 229/37 R; 40/312; 206/459; 229/70

[58] Field of Search ..... 206/459; 229/48 R, 485 B, 229/70, 74, 37 R; 40/312

[56] References Cited

U.S. PATENT DOCUMENTS

| | | | |
|---|---|---|---|
| 1,116,043 | 11/1914 | Elliott | 229/70 |
| 1,171,703 | 2/1916 | Cather | 229/70 |
| 2,134,971 | 11/1938 | Guyer | 40/312 |
| 2,840,296 | 6/1968 | Fromm | 229/70 |
| 3,099,381 | 7/1963 | Meyers | 229/37 R |
| 3,183,614 | 5/1965 | Loderhose | 229/37 R |
| 3,219,253 | 11/1965 | Davis | 229/37 R |
| 3,361,326 | 1/1968 | Crolex et al. | 229/37 R |
| 3,911,798 | 10/1975 | Whyte | 40/312 |
| 3,985,287 | 10/1976 | Stetler | 229/37 R |

FOREIGN PATENT DOCUMENTS

| | | | |
|---|---|---|---|
| 690,620 | 7/1964 | Canada | 40/312 |

*Primary Examiner*—George E. Lowrance
*Assistant Examiner*—Bruce H. Bernstein

[57] ABSTRACT

The present invention resides in the combination of a one-piece carton and an integral, removable coupon card wherein the carton employs both interior and exterior glue flaps. The coupon card is removably attached to the exterior glue flap of the carton and is releasably adhered to the exterior of a side wall of the carton while the interior glue flap is conventionally adhered to the inside of a side wall of the carton.

1 Claim, 5 Drawing Figures

CARTON WITH INTEGRAL REMOVABLE CARD

BACKGROUND OF INVENTION

Heretofore, a number of attempts have been made at combining a carton with a coupon or the like for redeeming goods and/or for the purpose of providing the consumer with information designed to be saved for future use. The following list of U.S. patents are believed to be exemplary of the prior efforts:

#2,134,971 (229-37)
#3,183,614 (40-312)
#3,219,253 (229-16)
#3,389,850 (229-16)

Each of the first two patents listed disclose coupons or the like that are adhered to the exterior of a carton side wall. In the case of the '971 patent, the coupon is removably attached to an exterior glue flap that extends for the full length of the carton side wall. In the '614 patent, the coupon is made a part of the exterior glue flap. Thus, in both cases, the coupons are readily available, but removal of the coupons produces an unsightly appearance to the cartons. Meanwhile, in the '253 and '850 patents, the coupons are located inside outer walls of the cartons so that the coupons cannot be removed while the cartons remain intact.

In accordance with the present invention, a coupon card is applied to an exterior wall of a carton so as to be readily available, but the manner in which the coupon card is attached to the carton blank is such that removal of the coupon does not appreciably affect the appearance of the carton. The invention is carried out by utilizing both interior and exterior glue flaps on the carton blank wherein the exterior glue flap is sized so as to be substantially equal in length to one dimension of the coupon card. The coupon card is removably attached to the end of the exterior glue flap and is releasibly spot adhered to an exterior side wall of the carton. The graphics printed on the carton side wall beneath the coupon card are correlated with the graphics on the coupon and on the exterior glue flap so that removal of the coupon does not change to any appreciable extent the appearance of the carton.

SUMMARY OF INVENTION

The present invention resides in a carton construction with an integral coupon card which employs both interior and exterior glue flaps. The interior glue flap is preferably of abbreviated length and is foldably attached to a first side wall of the carton. The exterior glue flap is also preferably of abbreviated length and is foldably attached to a second side wall of the carton that is the most remote side wall from the first side wall of the carton blank. When the carton blank is folded into its final carton shape, the exterior glue flap with its coupon card extension is adhered to the exterior of the side wall containing the interior glue flap and the interior glue flap is adhered to the interior of the side wall containing the exterior glue flap. The adhesive joints between the glue flaps and side walls are intended to be more-or-less permanent while the adhesive joint between the coupon card and side wall is preferably releasible. These desired results are carried out by careful application of the different amounts of adhesive to the glue flaps and coupon card.

The two glue flaps are spaced from one another along the longitudinal or side edges of the carton side walls such that the combined lengths of the two glue flaps is preferably slightly longer than the length of the carton side walls. Thus, when the carton is formed, the two glue flaps overlap only slightly in order to prevent any sifting of the packaged product from the carton at the juncture of the glue flaps. Too much overlap of the glue flaps at their juncture is not desireable because the increased thickness of the carton blank at that area presents problems with the 90° forming of the blank. Meanwhile, a continuous exterior glue flap is not desireable for esthetic reasons, and a continuous interior glue flap is not desireable because it requires that the coupon card be attached to a side wall of the carton. In the latter case, removal of the coupon card leaves a ragged side wall along the edge of the carton that is unsightly and which produces break up in the printed exterior. Moreover, with a continuous interior glue flap and a coupon attached to a carton side wall, forming problems are introduced. The compound fold of two plies of carton material in the region of such a coupon tends to create a fractured edge which prematurely ruptures the perforations between the carton side wall and attached coupon. This permits the coupons to release or partially release and jam mechanical filling equipment. Furthermore, even if the partially released coupons do not jam the filling equipment, they generally do not remain attached to the carton in the retail outlets which defeats the purpose for adding the coupons in the first place.

DETAILED DESCRIPTION

Figure 1:
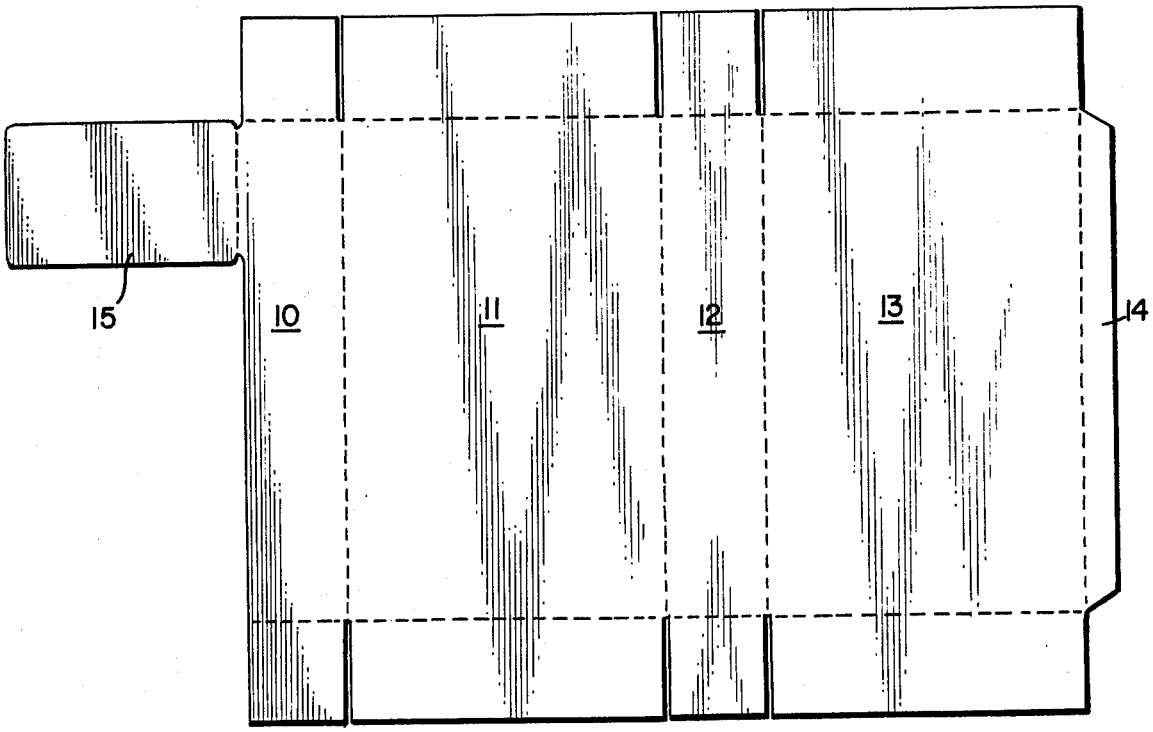
Fig 1 (PRIOR ART)
FIG. 1 shows in plan the prior art carton blank structure incorporating an integral coupon most recently used.
Figure 2:
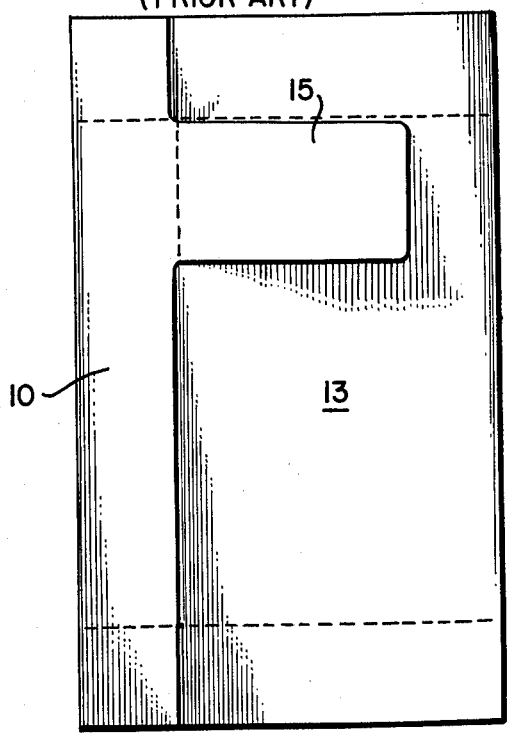
Fig 2. (PRIOR ART)
FIG. 2 shows in plan the folded and glued blank of FIG. 1.

Referring now to the drawings in detail it will be seen that there is illustrated in FIGS. 1 and 2 a prior art carton construction that has previously been used for the purpose of the present invention. The blank of FIG. 1 utilizes a plurality of side walls 10, 11, 12 and 13 separated from one another by score lines with an interior glue flap 14 foldably attached to one side wall and a coupon card 15 removably attached to another side wall. The carton formed from the blank of FIG. 1 has been used in the past for the same purposes as the carton of the present invention. However, its use has beem deemed undesireable because of the reasons set forth hereinbefore. Accordingly, to overcome the problems with the prior art cartons, the present carton was developed.

Figure 3:
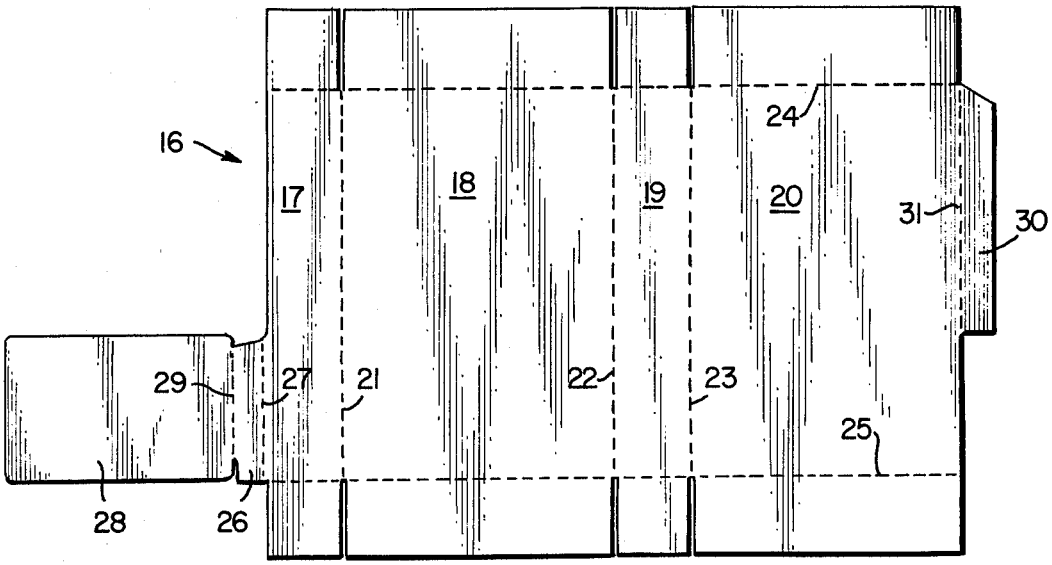
FIG. 3 shows in plan a typical carton blank structure according to the present invention.
Figure 4:
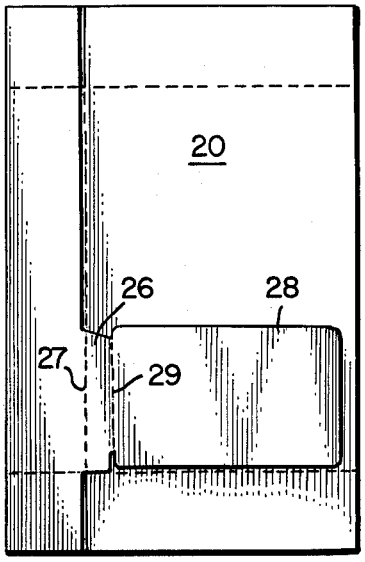
FIG. 4 shows in plan the folded and glued blank of FIG. 3.
Figure 5:
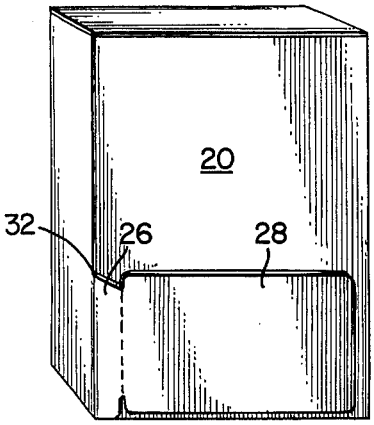
FIG. 5 is a perspective view of the folded and glued carton of the present invention.

FIGS. 3–5 show the blank and finished carton of the present invention. In FIG. 3, the blank 16 has conventional side walls 17, 18, 19 and 20 separated from one another along parallel fold lines 21, 22, 23. The blank further includes fold lines 24, 25 at the top and bottom thereof along which conventional top and bottom closure flaps are attached. Side wall 17 has attached thereto, an abbreviated exterior glue flap 26 along a score line 27. The exterior glue flap 26 in turn has attached thereto a coupon card 28 along a perforated line 29. The perforated line 29 permits the coupon card 28 to be easily removed from the glue flap 26 as desired. Meanwhile, side wall 20 which is the most remote side wall on blank 16 from side wall 17 has attached thereto a second abbreviated glue flap 30 along a fold line 31. The coupon card 28 is substantially equal in one of its dimensions (width) to the length of exterior glue flap 26.

At the other side of the blank 17, the interior glue flap 30 is also of abbreviated length and is spaced from the exterior glue flap 26 such that the combined length of the two flaps is preferably only slightly longer than the length of the carton side walls. Thus, when the carton blank 17 is folded and glued as shown in FIG. 4, the two glue flaps overlap each other only slightly to produce a shift proof corner seal 32.

The carton blank can be glued with either a straight line application of adhesive or with pad application of adhesive. In one method for carrying out the glueing step, the blank 17 is first turned printed side down. Side wall 20 is folded over along score line 23 and adhesive is applied to glue flaps 30 and 26 with a selected adhesive application to coupon card 28. Subsequently, the blank is folded over again about score line 21 to adhere the interior glue flap 30 to the inside of side wall 17, and the exterior glue flap 26 to the exterior of side wall 20. At the same time, the coupon card 28 is releasibly adhered to the exterior of side wall 20 to produce the folded blank shown in FIG. 4.

The cartons are generally shipped to the user in the glued condition shown in FIG. 4. After the cartons are filled, the top and bottom closure flaps are sealed to produce the final structure shown in FIG. 5.

It will thus be seen that the invention comprises the several steps and the relation of one or more of such steps with respect to each of the others, the carton blank embodiment, combinations and arrangements of parts which are adopted to effect such steps, and the assembled carton which possesses the characteristics, properties and relation of elements substantially as recited in the appended claims.

I claim:

1. In combination, a carton and integral coupon card constructed from a one piece cut and scored blank of paperboard or the like comprising, a plurality of main body side panels foldably attached to one another along parallel score lines, end closure flaps foldably attached to the upper and lower ends of said main body side panels and a first glue flap of a length less than the length of said main body side panels foldably attached to an end of one main body side panel, the improvement comprising, a second glue flap and integrally attached coupon card foldably attached to the opposite end of another main body side panel remote from said one main body side panel, said second glue flap having a length less than the length of said main body side panels and arranged on said blank to be longitudinally spaced from said first glue flap along the main body side panel such that the combined length of both said glue flaps is slightly longer than the length of said main body side panels, said first glue flap being adhered to the inside of said side panel to which said second glue flap is attached in the region adjacent to said second glue flap and said second glue flap being adhered to the outside of the side panel to which said first glue flap is attached in the region adjacent to said first glue flap, said arrangement of glue flaps serving to provide a slight overlap of the two glue flaps to form a completely glued joint along the entire length of the carton while placing the first glue flap interiorly of said carton and the second glue flap and attached coupon card exteriorly of said carton, said coupon card being releasibly adhered to the exterior of the body side panel to which the first glue flap is attached and removably attached to said second glue flap along a perforated score line.

* * * * *